US007992222B1

(12) United States Patent
Behrens

(10) Patent No.: US 7,992,222 B1
(45) Date of Patent: Aug. 9, 2011

(54) GARMENT WITH INTERSTITIAL FASTENER

(76) Inventor: Rochelle Behrens, Washington, DC (US)

( * ) Notice: Subject to any disclaimer, the term of this patent is extended or adjusted under 35 U.S.C. 154(b) by 340 days.

(21) Appl. No.: 12/249,893

(22) Filed: Oct. 10, 2008

(51) Int. Cl.

| | |
|---|---|
| ***A41B 1/10*** | (2006.01) |
| ***A41B 1/18*** | (2006.01) |
| ***A41D 1/00*** | (2006.01) |
| ***A41D 3/02*** | (2006.01) |

(52) U.S. Cl. ..... 2/128; 2/118; 2/96

(58) Field of Classification Search ..... 2/96, 118, 2/119, 128, 265, 266, 69, 79, 108, 114, 115, 2/122, 218, 219, 234, 235

See application file for complete search history.

(56) References Cited

U.S. PATENT DOCUMENTS

| | | | | |
|---|---|---|---|---|
| 139,937 | A * | 6/1873 | Wieser | 2/118 |
| 270,087 | A * | 1/1883 | Lynch et al. | 2/128 |
| 782,125 | A * | 2/1905 | Gentry | 2/96 |
| 1,498,489 | A | 6/1924 | Steinmetz | |
| 2,686,915 | A * | 8/1954 | Gatto | 2/128 |
| 3,208,082 | A * | 9/1965 | Di Paolo | 2/219 |
| 3,311,926 | A | 4/1967 | Gerber | |
| 3,495,274 | A * | 2/1970 | Isaacs | 2/96 |
| 3,787,896 | A | 1/1974 | Weiss | |
| 4,385,403 | A | 5/1983 | Richardson et al. | |
| 4,616,366 | A | 10/1986 | Mueller | |
| 4,797,954 | A | 1/1989 | Williams et al. | |
| 5,644,794 | A * | 7/1997 | Hull et al. | 2/102 |
| 6,192,522 | B1 * | 2/2001 | Schreib | 2/227 |
| 2007/0028368 | A1 | 2/2007 | Morton | |

FOREIGN PATENT DOCUMENTS

| | | | |
|---|---|---|---|
| GB | 840189 | * | 7/1960 |

OTHER PUBLICATIONS

All You, Look Good for Less, May 22, 2009, allyou.com, Issue 5, p. 34.*

* cited by examiner

*Primary Examiner* — Gary L Welch
*Assistant Examiner* — Amber R Anderson
(74) *Attorney, Agent, or Firm* — Plumsea Law Group, LLC

(57) ABSTRACT

A garment includes a first side, possibly corresponding to a user's front. The first side includes left and right portions that each have a free mating edge. Fastener elements are attached to or formed in each of the right and left portions of the garment. One of the two portions includes a two layer placket. Some of the fastener elements include a portion on the outer layer of the two layer placket. At least one interstitial fastener element is positioned only on the inner layer and is between two other fastener elements that include a portion on the outer layer. The at least one interstitial fastener element may be positioned at a wearer's chest or waist region to minimize or eliminate gapping of the shirt in areas of larger girth.

21 Claims, 11 Drawing Sheets

GARMENT WITH INTERSTITIAL FASTENER

BACKGROUND OF THE INVENTION

1. Field of the Invention

The present invention relates a garment with an opening that is selectively opened or closed with a combination of exposed fasteners and at least one hidden interstitial fastener to prevent gapping at its location.

2. Description of Related Art

Shirts or blouses with a button placket combine the ease of dressing with a complete or partial opening, with the neatness of a tailored appearance.

Many shirts have been designed that include an opening down the front. Some of these shirts have been closed with a row of buttons or snaps. However, the buttons, snaps, or other fasteners allow the shirt to gap in the areas between the buttons or snaps. This creates a messy appearance and potential embarrassment.

Other shirts have solved this problem by using a zipper or hook and loop closure system along the length of the opening. While this structure prevents gaps, it also presents an appearance that may be too casual for many situations or which may be somewhat unnatural compared to a standard shirt.

There is a need in the art for a system and method that addresses the shortcomings of the prior art discussed above.

SUMMARY OF THE INVENTION

In one aspect, a garment may have a first side having a first free edge and a second free edge capable of being joined to one another with a securing structure. The securing structure may include a plurality of fasteners and a two layer placket. The fasteners may be secured in spaced relationship to the first side adjacent the first free edge. The two layer placket may be on the first side adjacent the second free edge The two layer placket may include an outer layer and an inner layer. Each of the inner and outer layers may define holes capable of receiving one of the plurality of fasteners and may correspond in placement to one of the plurality of fasteners. The inner layer of the placket may have a larger number of holes than the outer layer of the placket.

Each fastener may pass through one hole in the inner placket. Each hole in the outer placket may be aligned with one hole in the inner placket. The inner placket may define at least one hole that is not aligned with a hole on the outer placket. The unaligned hole on the inner placket may be positioned between two holes in the inner placket that are aligned with holes in the outer placket. The unaligned hole on the inner placket may be positioned along the front of the shirt in a region that corresponds roughly to a wearer's chest or to a wearer's waist.

In another aspect, a garment may include a first side. The first side may have a first free edge and a second free edge that are capable of being joined through a fastening system. The fastening system may include a plurality of first fastener portions and second fastener portions. The first fastener portions may be positioned on the first side in spaced relationship adjacent the first free edge. The corresponding plurality of second fastener portions may be positioned on the first side in spaced relationship adjacent the second free edge. The second free edge may include an inner layer and an outer layer. At least one of the second fastener portions may be positioned on the inner layer. The inner layer may define holes allowing corresponding first and second fastener portions to interconnect. The at least one second fastener portion positioned on the inner layer may be positioned along the front of the shirt in a region that corresponds roughly to a wearer's chest or waist.

In another aspect, a garment may include a first side having a first free edge and a second free edge that are capable of being joined together. The second free edge may include an inner layer and an outer layer. A plurality of first fastener portions may be secured to the first side adjacent the first free edge. A plurality of second fastener portions may be attached to the second free edge. A first subset of the second fastener portions may be defined on the outer layer of the second free edge and at least one second fastener portion may be defined on the inner layer of the second free edge. The at least one second fastener portion defined on the inner layer may be positioned interstitially with respect to two of the first subset of second fastener portions defined on the outer layer.

The at least one second fastener portion defined on the inner layer of the second free edge may include a second subset of second fastener portions defined on the inner layer of the second free edge. Each of the second subset of second fastener portions may be positioned interstitially with respect to two of the first subset of second fastener portions defined on the outer layer. The at least one second fastener portion defined by the inner layer may be positioned along the garment in a region that corresponds roughly to a wearer's chest or waist.

In another aspect, a garment may include a first side defining a front opening formed of a first panel and a second panel adapted to be selectively attached and detached to one another along mating edges thereof. A plurality of fasteners may be arranged along the mating edge of said first panel. A double layer placket may be disposed along the entire length of the mating edge of said second panel. The double layer placket may include an inner layer and an outer layer. A plurality of fastener mating elements may be arranged along the entire length of the double layer placket and may extend through both the inner layer and the outer layer. At least one interstitial fastener mating element may extend only through the inner layer and may be disposed between two neighboring fastener mating elements such that the interstitial fastener mating element is covered by said outer layer.

The fasteners may be buttons and the fastener mating elements may be buttonholes. The interstitial fastener mating element and its corresponding fastener may be arranged on the garment in a region corresponding to a wearer's chest or waist when the garment is worn.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The various embodiments can be better understood with reference to the following drawings and description. The components in the figures are not necessarily to scale, emphasis instead being placed upon illustrating the principles of the embodiment. Moreover, in the figures, like reference numerals designate corresponding parts throughout the different views.

DETAILED DESCRIPTION OF THE PREFERRED EMBODIMENTS

Figure 1:
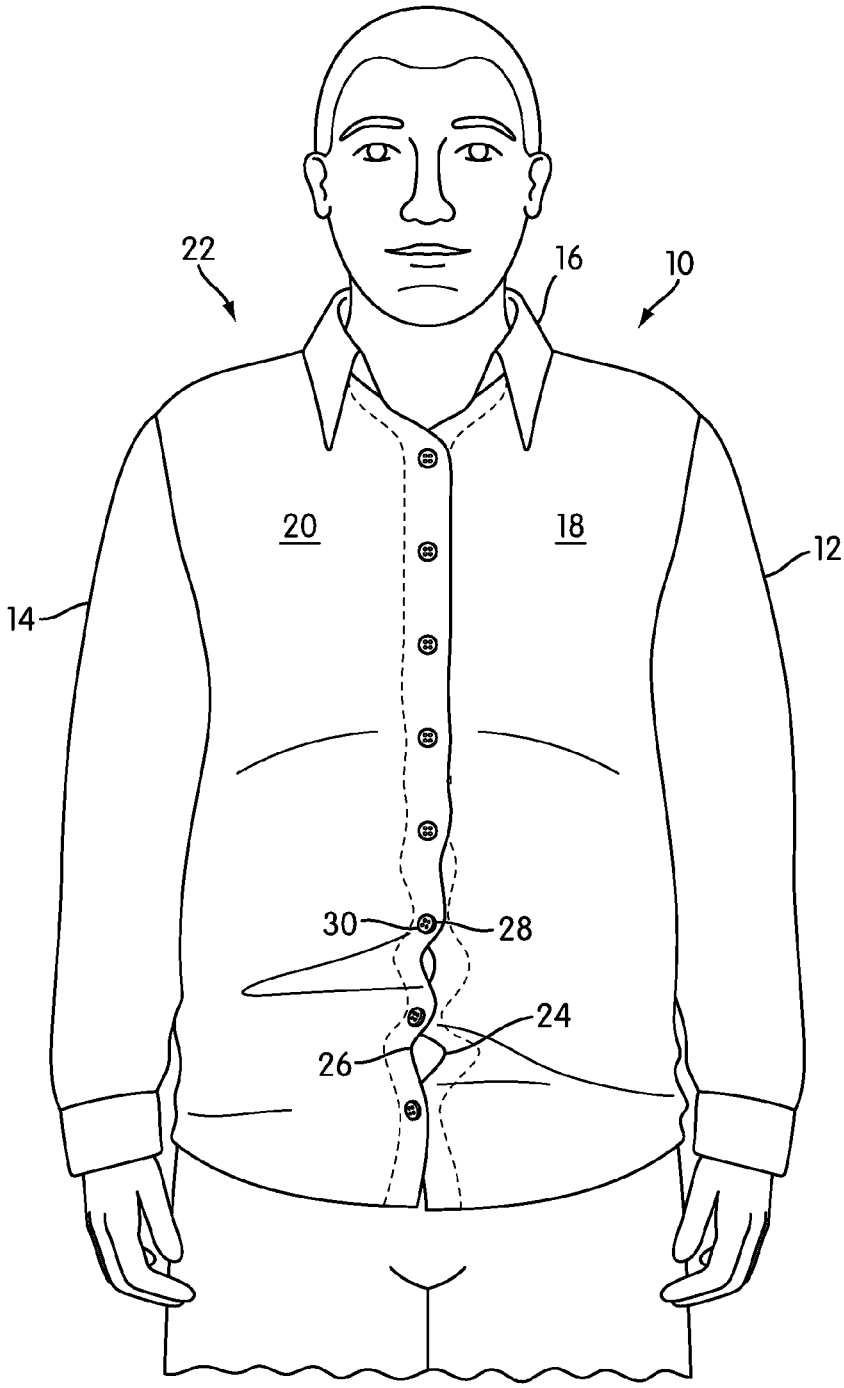
FIG. 1 PRIOR ART
FIG. 1 is a front view of a prior art shirt.

Turning first to FIG. 1, a prior art garment 10 is seen. The garment 10 in this instance is a shirt. The shirt 10 includes standard parts, including a back (not shown), two sleeves 12, 14, a collar 16, a first panel 18 and a second panel 20. The first and second panels 18, 20 together form a first side 22. The first and second panels 18, 20 each include a free edge 24, 26. A series of fastener elements 28, 30 are used to removably join the free edges 24, 26. In the view shown, the fastener elements 28, 30 are buttons and button holes, respectively. A primary difficulty with the prior art shirt 10 is evident in this Figure. Most shirts 10 are designed to lay best across a continuous surface or a surface with a precise geometric configuration. However, the human body is not designed with such regularity. While garments are typically designed with particular dimensions so that a shirt (for example) of a particular size fits particular users with similar dimensions, a human body often has areas of larger or smaller diameter than predicted by the sizing. For example, a person with a particular shoulder width may be predicted to have a smaller or larger girth in other areas of the torso than the person actually has. When this occurs, the shirt 10 tends to gap as is shown in FIG. 1.

Figure 2:
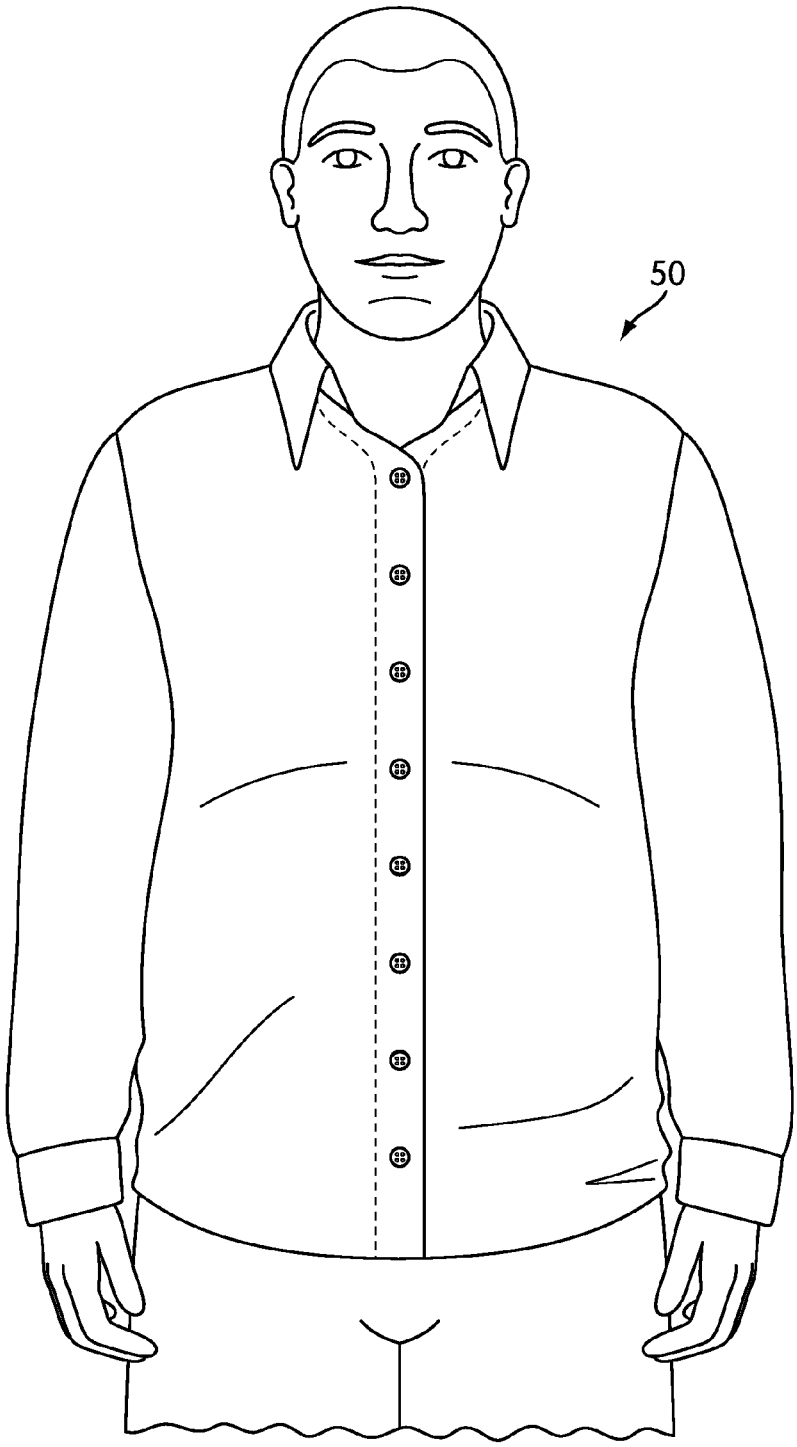
FIG. 2 is a front view of a first embodiment shown on a man.
Figure 3:
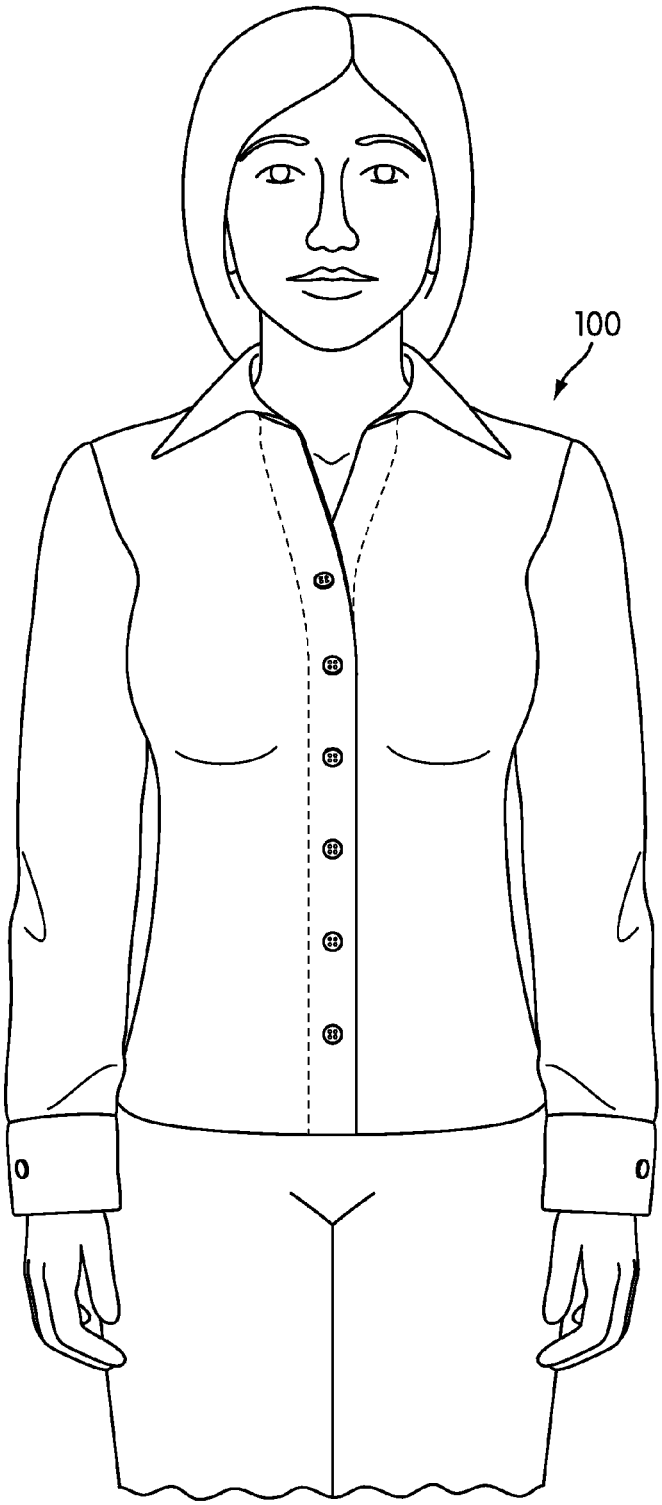
FIG. 3 is a front view of the first embodiment shown on a woman.

FIGS. 2 and 3 show a first embodiment 50, 100 on a man and woman, respectively. A comparison of FIGS. 2 and 3 with FIG. 1 shows how the use of the present embodiments improves the appearance of the garment. In FIGS. 2 and 3, each user has an area of greater girth. For the person in FIG. 2, the area of wider girth is in the waist area. For the person in FIG. 3, the area of wider girth is in the chest area. The use of the present embodiments improves the appearance in the area of wider girth.

Figure 4:
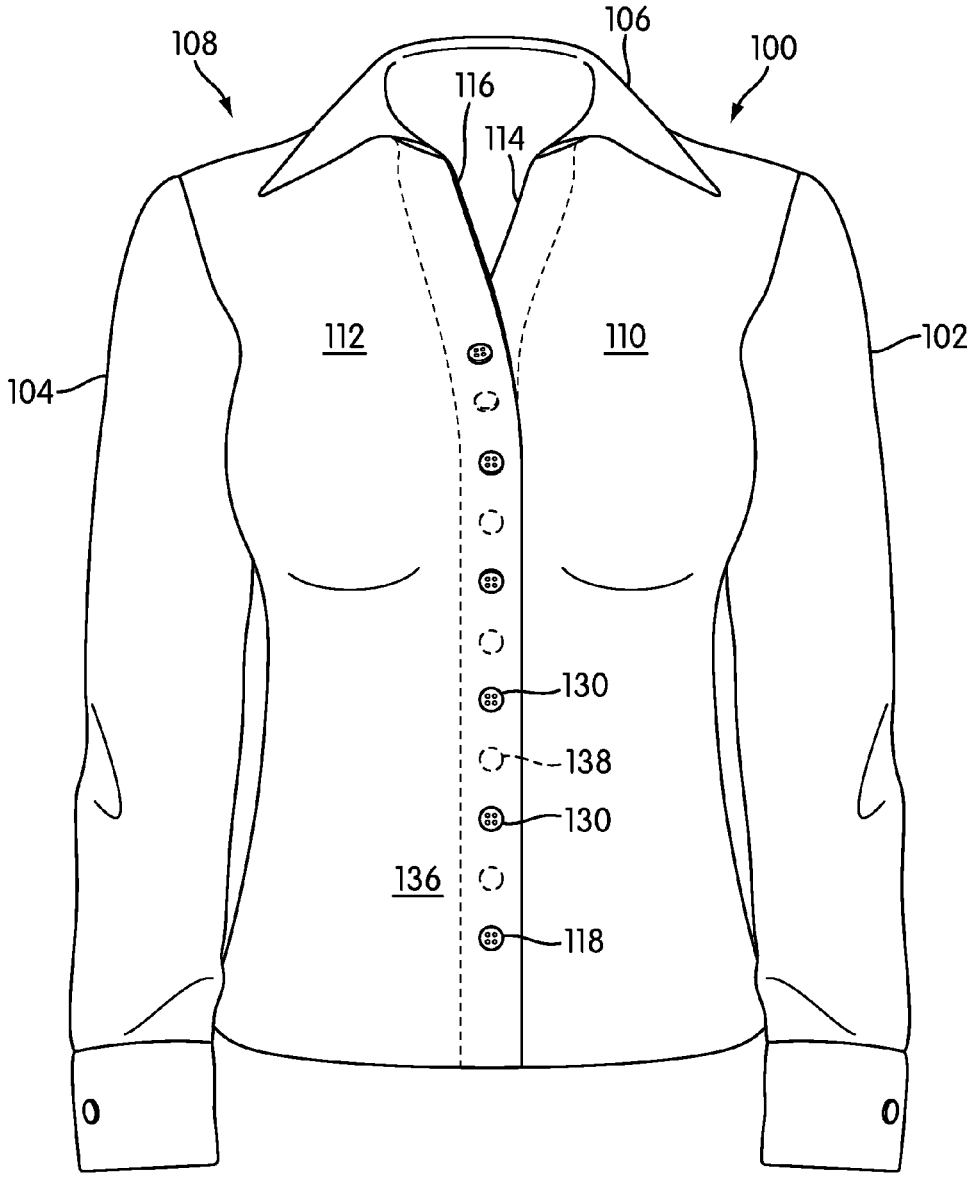
FIG. 4 is a front view of the first embodiment showing hidden elements in phantom.

Turning first to FIG. 4, the first embodiment 100 is shown. The garment 100 includes a back side (not shown), two arms 102, 104, a collar 106, and a first side 108. The first side 108 includes a first panel 110 and a second panel 112. The first panel 110 and second panel 112 are adapted to be selectively attached and detached to one another along their mating edges. First panel 110 includes a first free edge 114 and second panel 112 includes a second free edge 116. First free edge 114 and second free edge 116 together form the mating edges. As is shown in FIG. 4, a plurality of fasteners 118 are secured to the first panel 110. The fasteners 118 are placed in spaced relationship to one another adjacent the first free edge 114.

Figure 5:
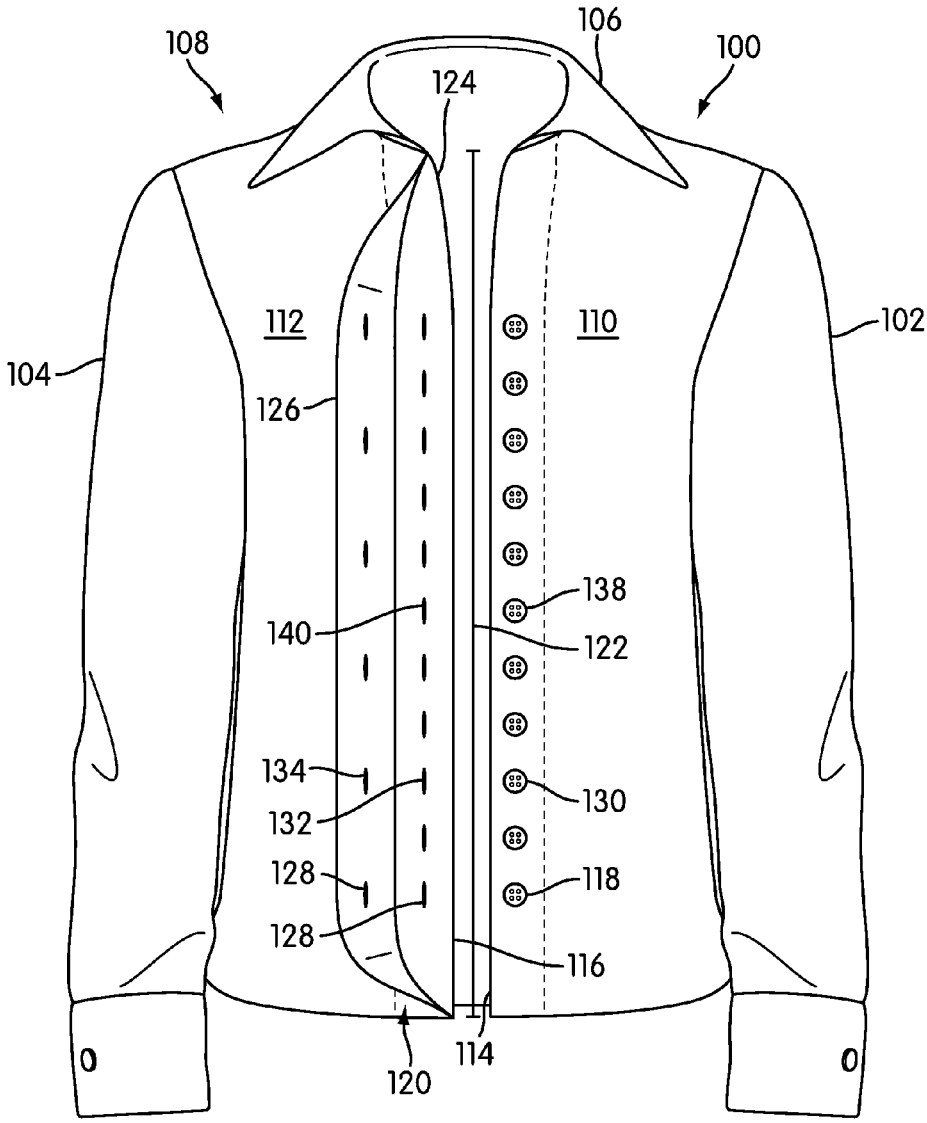
FIG. 5 is a front view of the first embodiment corresponding to FIG. 4 with all the hidden elements being visible.

FIG. 5 shows the first embodiment shown in FIG. 4. In FIG. 5, the two edges 114, 116 are shown as being disengaged from one another and all the fasteners and fastener elements are visible. FIG. 5 shows more clearly the fasteners or first fastener elements 118 that are adjacent the first free edge 114. FIG. 5 also shows more clearly the structure on the second free edge 116.

The second free edge 116 includes a two layer or double layer placket 120. The placket 120 extends the entire length 122 of the second free edge 116. The placket 120 includes an inner layer 124 and an outer layer 126. In this embodiment, the inner layer 124 and outer layer 126 each define holes or second fastener elements 128 that mate with the fasteners or first fastener elements 118 to join the first and second panels 110, 112.

In this embodiment, there are two ways in which the first and second fastener elements 118, 128 interact to join the first and second panels 110, 112 together. Looking first at one exemplary fastener or first fastener element 130, the fastener 130 is designed to penetrate through a hole or second fastener element 132 in the inner layer 124 of the double layer placket 120. The fastener 130 also penetrates through a hole 134 in the outer layer 126 of the double layer placket. As shown in FIG. 4, this fastener 130 becomes visible on the outer surface 136 of the garment 100. As also shown in FIG. 4, a plurality of such fasteners 130 is visible in this embodiment.

Looking now at another exemplary fastener or first fastener element 138, the fastener 138 is designed to penetrate through a hole or second fastener element 140 in the inner layer 124 of the double layer placket 120. However, this fastener 138 does not penetrate through the outer layer 126 of the placket 120. Instead the outer layer 126 covers this fastener 138, so that this fastener 138 remains hidden from view, as is shown in phantom in FIG. 4. At least one fastener 138 is placed interstitially between two neighboring fasteners 130 that penetrate through the outer layer 126. Because not every fastener 138 penetrates through the outer layer 126, when the second fastener elements 134, 140 are holes, the inner layer 124 will have a larger number of holes than the outer layer 126.

The positioning of the first fastener elements 130, 138 and the second fastener elements 134, 140 must be coordinated so that the fastener elements correspond in placement. If the position of the respective fastener elements is misaligned, such misalignment will create a source of gapping. In addition, the placket layers 124, 126 must be aligned so that the second fastener elements also correspond in placement with one another, except that for the hidden fasteners 138, the second fastener element 140 on the inner layer 124 does not have a corresponding second fastener element 134 on the outer layer 126 and is therefore unaligned with the outer layer fastener element.

Figure 6:
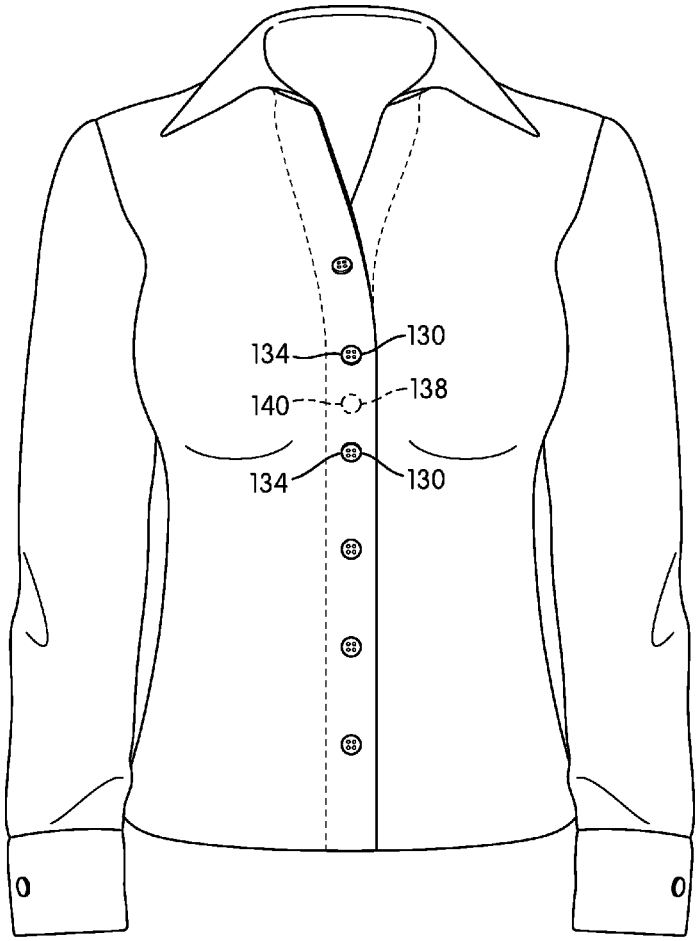
FIG. 6 is a front view of a first modification of the first embodiment showing hidden elements in phantom.
Figure 7:
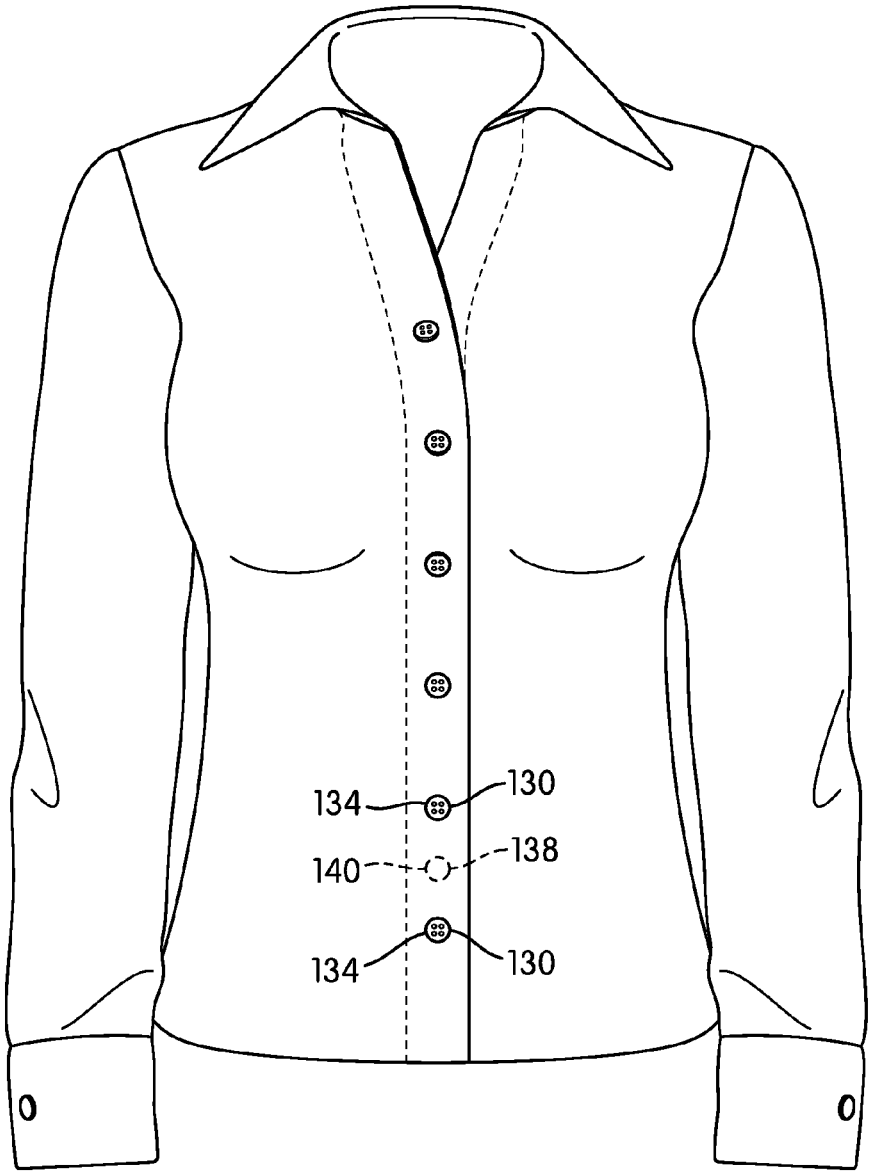
FIG. 7 is a front view of a second modification of the first embodiment showing hidden elements in phantom.

Turning now to FIGS. 6 and 7, an alternative positioning of the elements is disclosed. In FIGS. 4 and 5, the interstitial fastener elements 138, 140 are positioned interstitially between neighboring fastener elements 130, 134 for much of the length 122 of the panels 110, 112. However, in FIGS. 6 and 7, the interstitial elements 138, 140 are positioned only in the most needed areas. As shown in FIG. 6, for some users with a discontinuity in the chest area, the interstitial elements 138, 140 are positioned only in the chest area. Thus, these elements are positioned on the garment in a region to correspond roughly to the user's chest when the garment is worn. As shown in FIG. 7, for some users with a discontinuity in the waist area, the interstitial elements 138, 140 are positioned only in the waist area. Thus, these elements are positioned on the garment in a region to correspond roughly to the user's waist when the garment is worn.

The fasteners or fastener elements can be considered to be a plurality of fasteners or fastener elements that can be broken into two subsets. A first subset of fasteners or fastener elements includes the mating of a fastener or fastener element adjacent the first free edge to contact or penetrate the outer layer of the placket. A second subset of fasteners or fastener elements includes the mating of a fastener or fastener element adjacent the first free edge to contact or penetrate only the inner layer of the placket. This second subset of fasteners or fastener elements may be only one fastener or fastener element, as is shown in FIGS. 6 and 7. Alternatively, it may include a plurality of fasteners or fastener elements, as is shown in FIGS. 4 and 5.

Figure 8:
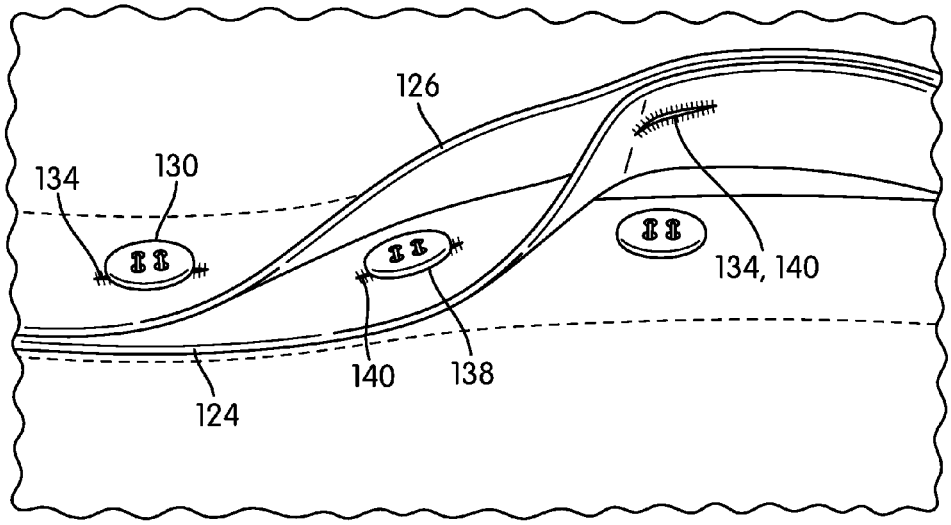
FIG. 8 is a side detail view of a third modification of the first embodiment.

A further modification of the present embodiment is shown in FIG. 8. FIG. 8 shows the details of the fastener elements in a side view. In FIG. 8, an alternative construction of the inner and outer plackets 124, 126 in combination with the second fastener elements 134, 140 is shown. In FIG. 8, it is shown that where there are second fastener elements 134 that allow the first fastener elements 130 to penetrate through the outer placket 126, the second fastener elements 134, 140 in those areas are formed by the stitching of a single buttonhole through both plackets 124, 126. The securing of the plackets 124, 126 to one another is a second fastener element 134, 140 that penetrates both the first and second plackets 124, 126.

Figure 9:
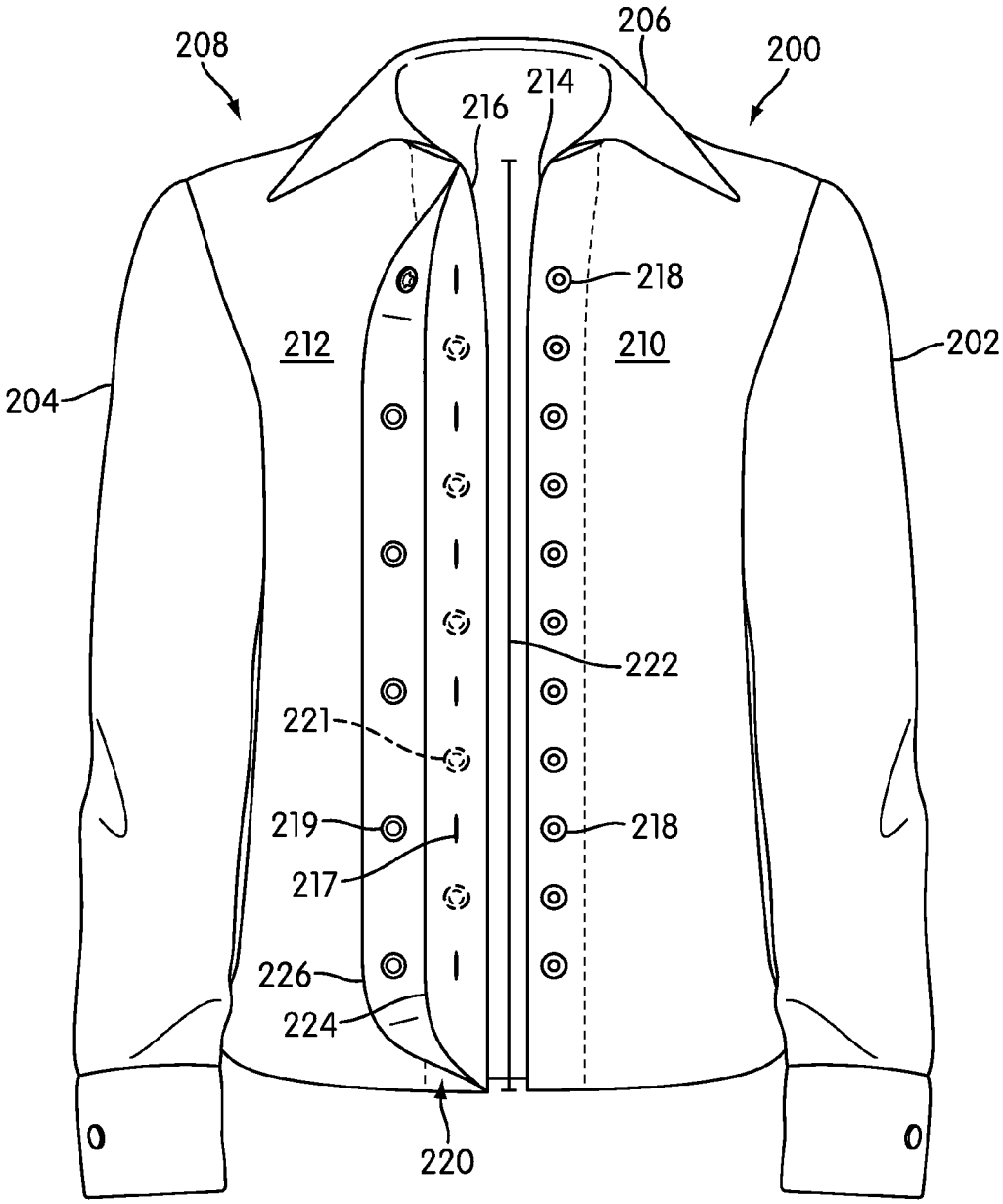
FIG. 9 is a front view of a fourth modification of the first embodiment in the same position as that shown in FIG. 5.

FIG. 9 shows an alternative embodiment. FIG. 9 shows a garment 200 that has many elements in common with garment 100 described above. The garment 200 includes a back side (not shown), two arms 202, 204, a collar 206, and a first side 208. The first side 208 includes a first panel 210 and a second panel 212. The first panel 210 and second panel 212 are adapted to be selectively attached and detached to one another along their mating edges. First panel 210 includes a first free edge 214 and second panel 212 includes a second free edge 216. First free edge 214 and second free edge 216 together form the mating edges. A plurality of first fastener portions 218 are secured to the first panel 210. The first fastener portions 218 are placed in spaced relationship to one another adjacent the first free edge 214.

The second free edge 216 includes a two layer or double layer placket 220. The placket 220 extends the entire length 222 of the second free edge 216. The placket 220 includes an inner layer 224 and an outer layer 226. In this embodiment, the inner layer 224 defines holes 217 that allow the first fastener portions 218 to contact some of the second fastener portions 219, 221 and allow the portions to interconnect.

Many of the second fastener portions 219 are positioned on the outer layer 226. In the illustrated embodiment, first and second fastener portions 218, 219, 221 are corresponding halves of snaps. Some of the second fastener portions 219 are positioned on the outer layer 226. In order for the first fastener portions 218 and the second fastener portions 219 to be able to fasten, the inner layer 224 must include a hole 217 that allows some section of one or both of the fastener portions 218, 219 to pass therethrough and contact the other of the fastener portions.

In addition to this configuration, one or more fastener portions 221 are connected to the inner layer 224 of the placket 220. This configuration allows the interconnection of the first and second fastener portions 218, 221 in a conventional manner.

The embodiment of FIG. 9 corresponds generally to FIG. 4, showing a plurality of second fastener portions 219 secured to the outer layer 226 and a plurality of second fastener portions 221 secured to the inner layer 224 interstitially between two neighboring second fastener portions 219 secured to the outer layer. It will be apparent to one of ordinary skill in the art that a configuration like that shown in FIGS. 6 and 7 could instead be used. Only one hidden interstitial second fastener portion 221 secured to the inner layer need be used as shown in those Figs.

FIG. 9 shows a different sort of fastener elements from those disclosed in connection with FIGS. 2-8 above. FIG. 9 shows the use of snaps. While FIGS. 2-8 show the use of buttons and button holes and FIG. 9 shows the use of snaps, a person having ordinary skill in the art could easily modify the design to use fasteners and fastener elements that have characteristics similar to those present in these two exemplary embodiments. A person having ordinary skill in the art will be able to modify the design of FIGS. 2-8 to use any sort of fastener where joining depends on the penetration of one fastener element through another to secure two items together. An example of an alternative fastening structure would be a cufflink or double button structure where the link would penetrate through the placket and also be secured to the first panel. An example of a structure similar to the snaps shown in FIG. 9 and described in further detail below would be a hook and eye structure, where two fastening elements are independently secured to the two panels and the two elements have mating portions that interlock to secure the panels to one another. Other, similar fastening structures may be alternatively used and should be considered to be included in the language that describes the particular embodiments illustrated and described.

Figure 10:
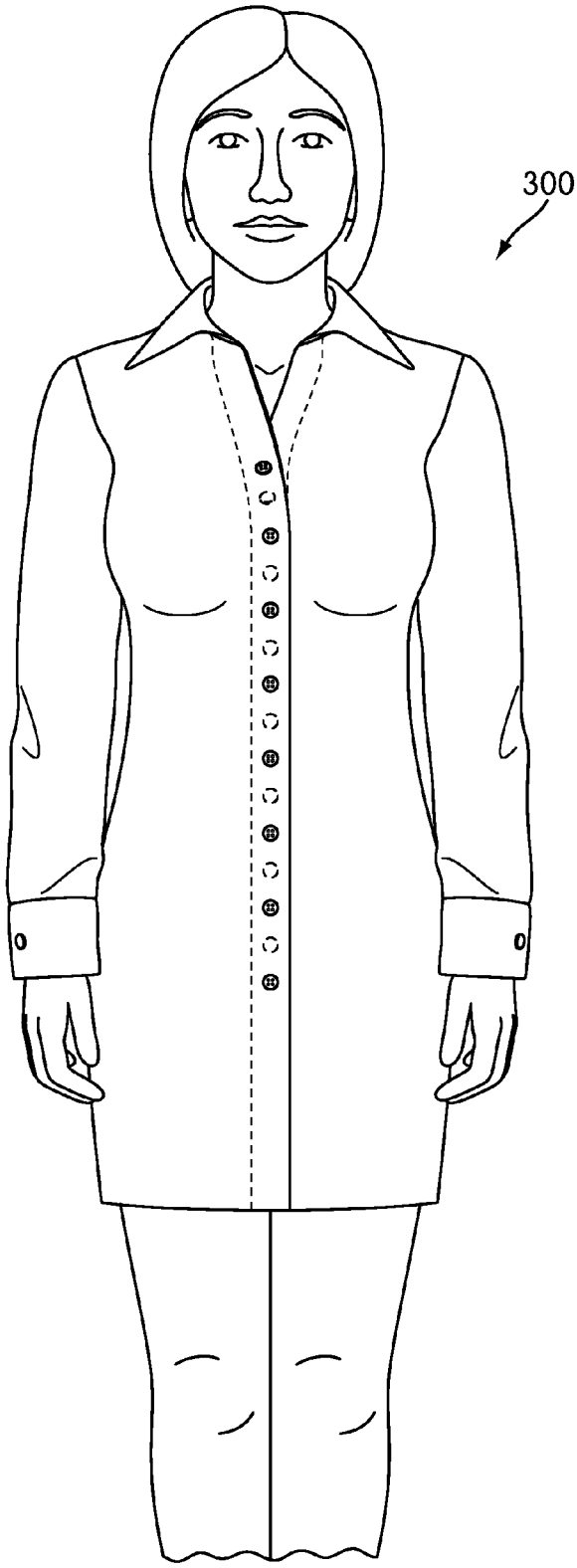
FIG. 10 is a front view of the first embodiment shown in use on an alternative garment.
Figure 11:
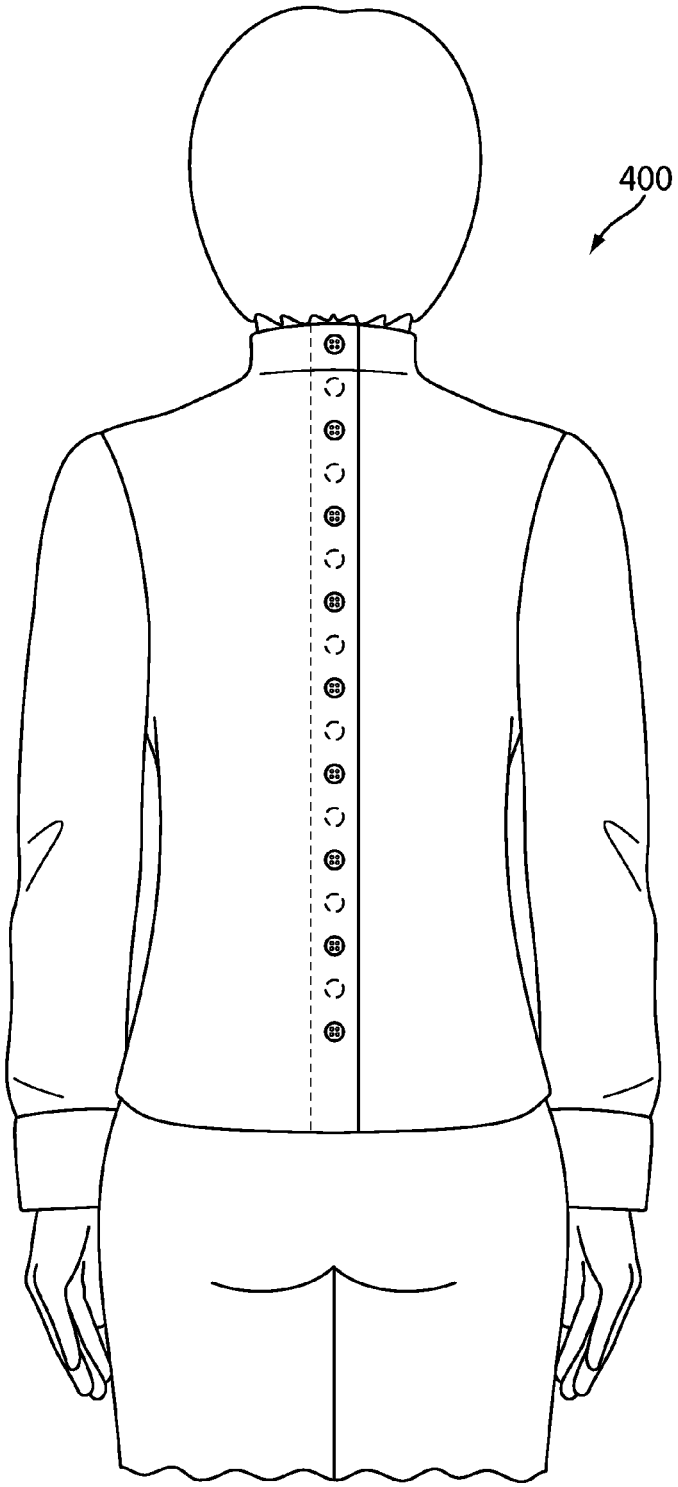
FIG. 11 is a front view of the first embodiment shown in use on a second alternative garment.

The present embodiments have been shown in connection with shirts that have a front closure. However, the embodiments are not so limited in their application. FIG. 10 shows an alternative garment 300. Garment 300 is a shirt dress that includes fasteners that are positioned similarly to those disclosed in connection with the embodiments described earlier. FIG. 11 shows an alternative garment 400. Garment 400 is a shirt that is fastened in the back and which includes fasteners that are positioned similarly to those disclosed in connection with the embodiments described earlier. Also of note is that for garment 400, the fasteners reach the full length of the placket. Any of the garments shown could include fasteners that extend any length along the placket. In addition, the present embodiments could be used on a variety of other garments. Various garments can be envisioned that include fasteners on the front, back, sides and other locations. Any of those garments may fall prey to the gapping that is common among shirts. Any of those garments may also be modified to include the features of the embodiments shown and described in detail earlier. The precise position or location of the fastener elements on a particular garment does not greatly affect the structure or function of the embodiments, and therefore those garments should be considered to fall within the scope of the present language. In addition, in any alternative garment, there could be one or a plurality of hidden interstitial fasteners or fastener elements, depending on the needs of the user, ease of manufacture, style, or the like.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

I claim:

1. A garment, comprising:

a first side having a first free edge and a second free edge capable of being joined to one another with a securing structure, the securing structure comprising:

a plurality of fasteners secured in spaced relationship to the first side adjacent the first free edge;

a two layer placket on the first side adjacent the second free edge, the two layer placket having an outer layer and an inner layer, each of the inner and outer layers defining holes capable of receiving one of the plurality of fasteners and corresponding in placement to one of the plurality of fasteners, the inner layer of the placket having a larger number of holes than the outer layer of the placket;

wherein each hole on the outer placket is aligned with one hole on the inner placket; and wherein at least one of the holes on the inner placket that is aligned with one hole on the outer placket is positioned between at least two holes on the inner placket that are unaligned with holes on the outer placket.

2. The garment of claim 1, wherein a plurality of the holes on the inner placket that are aligned with holes on the outer placket are each positioned between at least two holes on the inner placket that are unaligned with holes on the outer placket.

3. The garment of claim 1, wherein every other hole on the inner placket is aligned with a hole on the outer placket.

4. The garment of claim 1, wherein the plurality of fasteners include buttons.

5. The garment of claim 1, wherein at least one of the unaligned holes on the inner placket is positioned between two of the holes on the inner placket that are aligned with holes on the outer placket.

6. The garment of claim 1, wherein at least one of the unaligned holes on the inner placket is positioned along the front of the garment in a region that corresponds roughly to a wearer's chest.

7. The garment of claim 1, wherein at least one of the unaligned holes on the inner placket is positioned along the front of the garment in a region that corresponds roughly to a wearer's waist.

8. A garment comprising:

a first side having a first free edge and a second free edge that are capable of being joined through a fastening system, wherein the fastening system comprises:

a plurality of first fastener portions positioned on the first side in spaced relationship adjacent the first free edge;

a corresponding plurality of second fastener portions positioned on the first side in spaced relationship adjacent the second free edge;

wherein the second free edge comprises an inner layer and an outer layer, at least one of said second fastener portions positioned on the inner layer and a plurality of said second fastener portions positioned on the outer layer; and wherein the inner layer defines holes allowing corresponding first fastener portions and second fastener portions positioned on the outer layer to interconnect, wherein the holes are aligned with every other first fastener portion positioned on the first side adjacent the first free edge.

9. The garment of claim 8, wherein the at least one second fastener portion positioned on the inner layer is positioned along the front of the garment in a region that corresponds roughly to a wearer's chest.

10. The garment of claim 8, wherein the plurality of first fastener portions include halves of snaps.

11. A garment, comprising:

a first side having a first free edge and a second free edge that are capable of being joined to one another, the second free edge having an inner layer and an outer layer;

a plurality of first fastener portions secured to the first side adjacent the first free edge;

a plurality of second fastener portions attached to first side adjacent the second free edge, wherein a first subset of second fastener portions are defined on the outer layer of the second free edge and a second subset of second fastener portions are defined on the inner layer of the second free edge, at least one second fastener portion defined on the outer layer being positioned interstitially with respect to two of the plurality of second fastener portions defined on the inner layer; and wherein the entirety of the plurality of first fastener portions includes one of male fasteners portions and female fastener portions and the entirety of the plurality of second fastener portions includes the other of male fastener portions and female fastener portions.

12. The garment according to claim 11, wherein each of the second subset of second fastener portions are positioned interstitially with respect to two of the first plurality of second fastener portions defined on the outer layer.

13. The garment according to claim 11, wherein the second subset of second fastener portions defined on the inner layer are positioned along the garment in a region that corresponds roughly to a wearer's chest.

14. The garment according to claim 11, wherein the second subset of second fastener portions defined on the inner layer are positioned along the garment in a region that corresponds roughly to a wearer's waist.

15. A garment comprising:

a first side defining a front opening formed of a first panel and a second panel adapted to be selectively attached and detached to one another along mating edges thereof;

a plurality of fasteners arranged along the mating edge of the first panel;

a double layer placket disposed along the entire length of the mating edge of said second panel, said double layer placket comprising an inner layer and an outer layer, a plurality of fastener mating elements extending only through the inner layer such that the plurality of fastener mating elements are covered by said outer layer; and at least one interstitial fastener mating element extending through both the inner layer and outer layer and disposed between two of the fastener mating elements that extend only through the inner layer.

16. The garment of claim 15, wherein the fasteners are buttons and the fastener mating elements are buttonholes.

17. The garment of claim 15, wherein the interstitial fastener mating element and its corresponding fastener are arranged on the garment in a region corresponding to a wearer's chest when the garment is worn.

18. The garment of claim 15, wherein the interstitial fastener mating element and its corresponding fastener are arranged on the garment in a region corresponding to a wearer's stomach when the garment is worn.

19. A placket construction for a garment comprising:

a first edge comprising three fasteners affixed thereon;

a second edge comprising a dual layer placket with an inner layer and an outer layer and with three mating structures in aligned relationship with said three fasteners of said first edge to enable said first edge and said second edge to secure together to form an enclosure for said garment, a central one of said mating structures disposed only on said inner layer and covered by said outer layer, and the mating structures surrounding said central one are disposed on both said inner layer and said outer layer so as to attach them together;

wherein said three fasteners are secured to respective aligned mating structures such that the central fastener and mating structure connect said first edge to said inner layer, and the fasteners and mating structures surrounding said central one connect said first edge to both said inner layer and said outer layer; and wherein the three fasteners include one of male fastener portions and female fastener portions and the three mating structures include the other of male fastener portions and female fastener portions.

20. The placket construction of claim 19, wherein said fasteners are buttons, and said mating structures are buttonholes such that said central mating structure comprises a buttonhole in said inner layer, and the surrounding mating structures each comprise a buttonhole through both said inner layer and said outer layer.

21. The placket construction of claim 19, wherein said fasteners are male snap portions, and said mating structures are female snap portions such that said central mating structure comprises a female snap portion attached to said inner layer, and the surrounding mating structures each comprise a female snap portion attached to both said inner layer and said outer layer.

* * * * *